US011520363B2

(12) United States Patent
Daanen et al.

(10) Patent No.: US 11,520,363 B2
(45) Date of Patent: Dec. 6, 2022

(54) SYSTEM INCLUDING A LOW DROP-OUT REGULATOR THAT PROVIDES SUPPLY VOLTAGE TO DIGITAL LOGIC CONTROLLER CONFIGURED TO SELECT MODE OF THE LOW DROP-OUT REGULATOR

(71) Applicant: NXP B.V., San Jose, CA (US)

(72) Inventors: Antonius Martinus Jacobus Daanen, Beuningen (NL); Klaas-Jan de Langen, Bergschenhoek (NL); Sybren Matthias Bouwhuis, Nieuwleusen (NL)

(73) Assignee: NXP B.V., Eindhoven (NL)

( * ) Notice: Subject to any disclaimer, the term of this patent is extended or adjusted under 35 U.S.C. 154(b) by 49 days.

(21) Appl. No.: 17/028,186

(22) Filed: Sep. 22, 2020

(65) Prior Publication Data

US 2021/0124381 A1 Apr. 29, 2021

(30) Foreign Application Priority Data

Oct. 25, 2019 (EP) ..... 19205479

(51) Int. Cl.
*G05F 1/56* (2006.01)
*G05F 1/46* (2006.01)

(52) U.S. Cl.
CPC ..... *G05F 1/56* (2013.01); *G05F 1/462* (2013.01); *G05F 1/468* (2013.01)

(58) Field of Classification Search
CPC . G05F 1/46; G05F 1/461; G05F 1/462; G05F 1/465; G05F 1/468; G05F 1/56–595; H02M 1/0012; H02M 1/0041; H02M 1/08; H02M 1/0845; H02M 1/36; H02M 3/156; H02M 3/157
USPC ..... 323/222–226, 266, 268–275, 282–285, 323/299, 303, 304, 311–317, 351, 901; 363/49; 327/141–143, 538–543
See application file for complete search history.

(56) References Cited

U.S. PATENT DOCUMENTS 8,976,549 B2 3/2015 Berghegger
10,444,780 B1 10/2019 Cheng et al.
(Continued)

FOREIGN PATENT DOCUMENTS

CN 102650893 B 9/2014
CN 106227282 A 12/2016
CN 106300962 B 6/2019

*Primary Examiner* — Thienvu V Tran
*Assistant Examiner* — Carlos O Rivera-Perez

(57) ABSTRACT

A system comprising: a LDO regulator configured to receive a supply voltage and provide an output voltage based on a function of the supply voltage, the LDO regulator switchable between at least a first and second mode, wherein the first and second modes each define the output voltage provided to the output terminal based on different functions of the supply voltage; and a digital logic controller configured to select the mode of the LDO regulator by control signalling to the LDO regulator, the digital logic controller configured to receive power for the provision of the control signalling from the LDO regulator; wherein the LDO regulator comprises LDO start-up circuitry configured to cause the LDO regulator, during start-up, to default to a predetermined one of the first and second mode and the LDO start-up circuitry further configured to prevent the digital logic controller from controlling the mode of the LDO regulator.

20 Claims, 2 Drawing Sheets

(56) References Cited

U.S. PATENT DOCUMENTS

| | | | | |
|---|---|---|---|---|
| 2013/0271107 | A1* | 10/2013 | Grassier | G05F 1/10 323/349 |
| 2014/0145695 | A1 | 5/2014 | Riedel et al. | |
| 2015/0198960 | A1* | 7/2015 | Zhang | G05F 1/56 323/280 |
| 2016/0124248 | A1* | 5/2016 | Humphreys | A61F 2/16 351/158 |

* cited by examiner

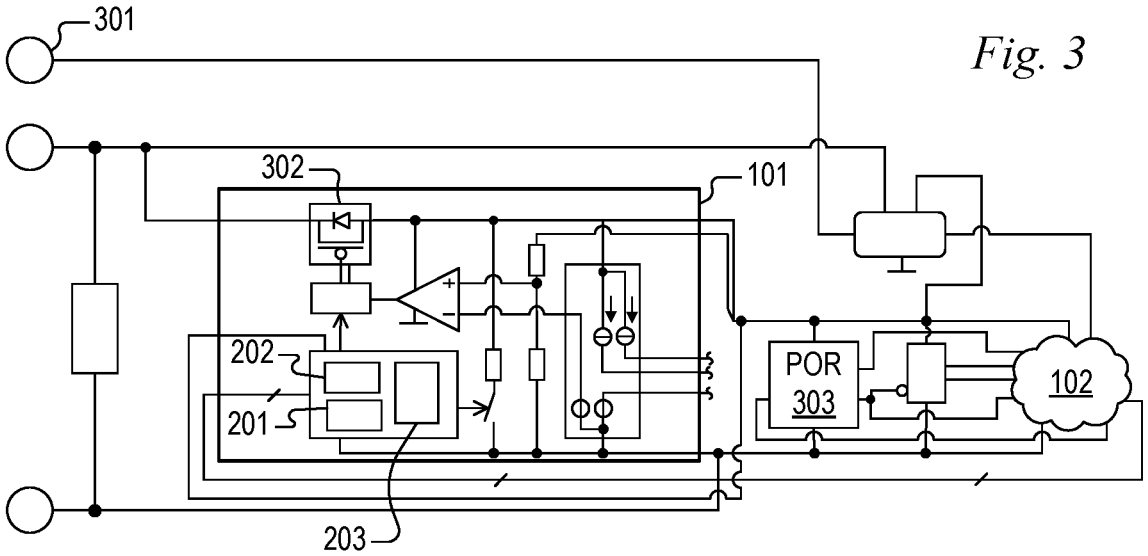
Fig. 3
Fig. 4
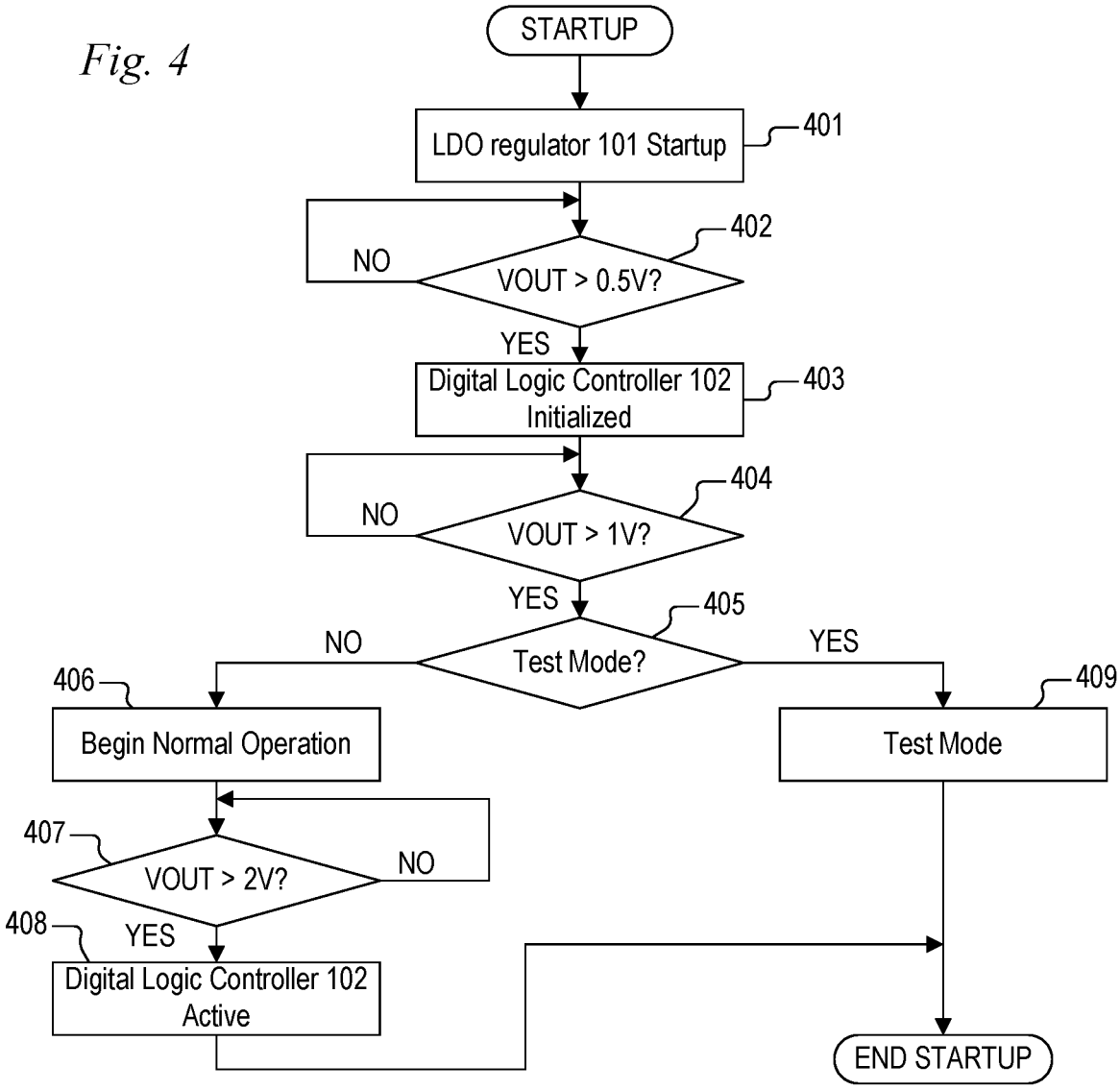

SYSTEM INCLUDING A LOW DROP-OUT REGULATOR THAT PROVIDES SUPPLY VOLTAGE TO DIGITAL LOGIC CONTROLLER CONFIGURED TO SELECT MODE OF THE LOW DROP-OUT REGULATOR

CROSS-REFERENCE TO RELATED APPLICATIONS

This application claims the priority under 35 U.S.C. § 119 of European Patent application no. 19205479.9, filed on 25 Oct. 2019, the contents of which are incorporated by reference herein.

FIELD

The present disclosure relates to a low drop-out (LDO) regulator and a method of operating a LDO regulator.

BACKGROUND

LDO regulators may be used to provide an output voltage for other circuitry, LDO regulators may be controlled by digital logic controllers. Digital logic controllers may provide signalling to the LDO regulator to control an operating mode of the LDO, which may affect the output voltage. The digital logic controller also requires a source of power to operate.

SUMMARY

According to a first aspect of the present disclosure there is provided a system comprising:

a low drop-out, LDO, regulator configured to receive a supply voltage at an input terminal and provide an output voltage at an output terminal based on a function of the supply voltage, the LDO regulator configured to be switchable between at least a first mode and a second mode, wherein the first and second modes each define the output voltage provided to the output terminal based on different functions of the supply voltage; and a digital logic controller configured to select the mode of the LDO regulator by providing control signalling to the LDO regulator, the digital logic controller configured to receive power for the provision of the control signalling from the output voltage provided by the LDO regulator;

wherein the LDO regulator comprises LDO start-up circuitry configured to cause the LDO regulator, during start-up, to default to a predetermined one of the first and second mode and the LDO start-up circuitry further configured to prevent the digital logic controller from controlling the mode of the LDO regulator.

In one or more embodiments, the LDO start-up circuitry is configured to monitor the voltage at the output terminal of the LDO regulator and, based on the monitored voltage being below a threshold, cause the LDO regulator to default to the predetermined one of the first and second mode and prevent the digital logic controller from controlling the mode of the LDO regulator.

In one or more embodiments, the LDO regulator is provided on an integrated circuit and the digital logic controller is provided on the same integrated circuit.

In one or more embodiments, the LDO regulator includes LDO digital logic to receive the control signalling from the digital logic controller and place the LDO regulator in one of the first and second mode; and the system comprises a level shifter configured to provide for shifting of voltage levels of the control signalling output by the digital logic controller prior to receipt of said control signalling by the LDO digital logic, and wherein the LDO start-up circuitry is configured to control the output of the level shifter such that the LDO start-up circuitry and the level shifter provide:

a first state wherein the control signalling is prevented from being provided to the LDO digital logic and, instead, predetermined signalling is provided to the LDO digital logic to cause the LDO regulator to operate in the predetermined mode; and a second state wherein the control signalling from the digital logic controller is provided to the LDO digital logic.

In one or more embodiments, the LDO start-up circuitry is configured to monitor the output voltage provided to the digital logic controller by the LDO regulator wherein the LDO start-up circuitry is further configured to provide signalling to the level shifter to provide the first state and the second state based on the output voltage.

In one or more embodiments, the LDO start-up circuitry is configured to provide signalling to the level shifter to provide:

the first state when the output voltage is above a first threshold voltage and below a second threshold voltage, the second threshold voltage greater than the first threshold voltage; and the second state when the output voltage is above the second threshold.

In one or more embodiments, the first threshold voltage may be 0, or less than 0.2, 0.3, 0.4, 0.5, 0.6 Volts or any other voltage value suitable for the system in question. In one or more embodiments, the second threshold voltage may be at least 1V, 1.5V, or 2V.

In one or more embodiments, the first mode is configured to provide an output voltage that is greater than or equal to a minimum acceptable operating voltage of the digital logic controller to the digital logic controller and the second mode is configured to provide an output voltage which is below the minimum acceptable operating voltage of the digital logic controller to the digital logic controller, wherein the predetermined one of the first and second mode is the first mode.

In one or more embodiments, the minimum acceptable operating voltage is a voltage below which the digital logic controller will not operate or will not operate optimally. The minimum operating voltages of electronic components are typically well defined values which are often contained in specification sheets for the components. The minimum acceptable operating voltage in the first mode may be provided to the digital logic controller after the start-up period, during which the voltage may increase until it reaches at least the minimum acceptable operating voltage.

In one or more embodiments, the first mode comprises one of:

a regulating mode wherein the output voltage provided at the output terminal is a substantially constant, non-zero output voltage; and a zero-current bypass mode wherein the output voltage provided at the output terminal is dependent on the input voltage received at the input terminal; and the second mode comprises one of:

a zero-voltage mode wherein the output voltage is equal to, or substantially equal to zero relative to a reference voltage; and a test mode.

In one or more embodiments, the reference voltage may be a ground.

In one or more embodiments, the mode to which the LDO regulator is configured to default during start-up is selectable. In one or more embodiments, said predetermined mode of the first and second modes is set at the time of manufacture.

In one or more embodiments, the LDO regulator comprises a test terminal for receiving a test signal indicative that the system is to be tested, wherein the LDO regulator is configured to, based on receipt of the test signal, override the control signalling from the digital logic controller and enter a test mode.

In one or more embodiments, a test signal may be sent to the test terminal post-manufacture for early testing of the device, thereby reducing wait times for post-manufacture testing.

In one or more examples the LDO regulator comprises an analog LDO regulator.

In one or more embodiments, the output voltage is configured to be provided to load circuitry in addition to the digital logic controller for the provision of power to the load circuitry.

According to a second aspect of the present disclosure there is provided a method of operating a system, the system comprising a low drop-out LDO, regulator configured to receive a supply voltage at an input terminal and provide an output voltage at an output terminal based on a function of the supply voltage, the LDO regulator configured to be switchable between at least a first mode and a second mode, wherein the first and second modes each define the output voltage provided to the output terminal based on different functions of the supply voltage; and a digital logic controller configured to select the mode of the LDO regulator by providing control signalling to the LDO regulator, the digital logic controller configured to receive power for the provision of the control signalling from the output voltage provided by the LDO regulator;

the method comprising:

during start-up, by LDO start-up circuitry, causing the LDO regulator to default to a predetermined one of the first and second mode; and during start-up, LDO start-up circuitry, preventing the digital logic controller from controlling the mode of the LDO regulator.

In one or more embodiments, the method comprises switching, LDO start-up circuitry, from a first state to a second state;

the first state comprising preventing the digital logic controller from providing the control signalling to the LDO regulator and, instead, providing predetermined signalling to the LDO regulator to cause the LDO regulator to operate in the predetermined mode; and the second state comprising allowing the digital logic controller to provide the control signalling to the LDO regulator.

wherein the method further comprises monitoring the output voltage provided to the digital logic controller by the LDO regulator and controlling said switching based on the output voltage.

In one or more embodiments, the method comprises causing the system to operate in:

the first state when the output voltage is above a first threshold voltage; and the second state when the output voltage is above a second threshold.

In one or more embodiments, the method comprises the system includes a level shifter configured to provide for shifting of voltage levels of the control signalling output by the digital logic controller prior to receipt of said control signalling by the LDO digital logic, and wherein said first state and said second state are provided by the LDO start-up circuitry controlling the output of the level shifter.

In one or more examples, the method comprises;

based on receipt of the test signal at the LDO regulator, preventing the digital logic controller from controlling the mode of the LDO regulator; and causing the LDO regulator to operate in a test mode.

According to a third aspect of the present disclosure there is provided a telecommunications system comprising the system of the first aspect.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

The above discussion is not intended to represent every example embodiment or every implementation within the scope of the current or future Claim sets. The figures and Detailed Description that follow also exemplify various example embodiments. Various example embodiments may be more completely understood in consideration of the following Detailed Description in connection with the accompanying Drawings.

BRIEF DESCRIPTION OF THE DRAWINGS

One or more embodiments will now be described by way of example only with reference to the accompanying drawings in which:

FIG. 3 shows yet another example embodiment of a system of the present disclosure; and FIG. 4 shows an example method of operating a system according to one embodiment.

DETAILED DESCRIPTION

Low drop out (LDO) regulators are used in circuits to supply other circuits, such as on-integrated-circuit load circuits, with a supply voltage. The supply voltage may be based on, i.e. as a function of, an input voltage received by the LDO regulator at an input terminal. In one or more example, the function may comprise the provision of a substantially constant or regulated supply voltage. LDO regulators may be configured to operate in a plurality of modes. Each mode may correspond to a different output voltage or range of output voltages, which may be understood as a function applied to the input voltage in order to provide an output voltage. During normal operation, in order to control the mode of the LDO regulator, a digital logic controller may be configured to provide control signalling to the LDO regulator which controls the operational mode of the LDO regulator.

It will be appreciated that, while the present disclosure is primarily directed towards LDO regulators, the concepts disclosed herein may be applied to any voltage regulator circuit.

Figure 1:
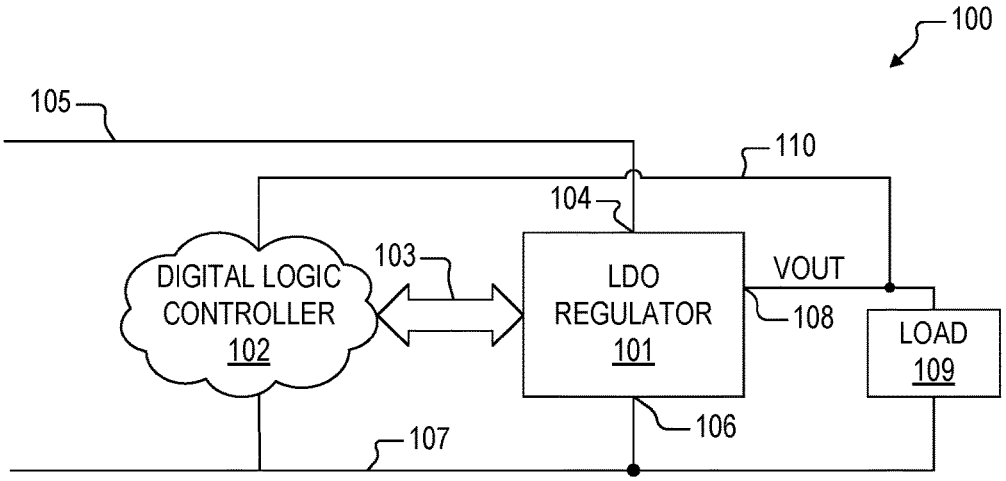
FIG. 1 shows an example embodiment of a system of the present disclosure.

FIG. 1 shows a system 100 comprising an LDO regulator 101 and a digital logic controller 102. The digital logic controller 102 is configured to provide the control signalling to the LDO regulator 101 via one or more signalling lines 103. The LDO regulator 101 has an input terminal 104 for coupling to voltage rail 105 for receiving an input voltage (e.g. a source of power for its operation). The LDO regulator 101 also has a reference terminal 106 for coupling to a reference voltage rail or terminal 107, such as a ground rail or terminal.

It will be appreciated that the input voltage may be provided with reference to the reference voltage, such as ground. Accordingly, where there is reference to an input voltage, this may comprise the voltage difference between the input terminal of the LDO regulator and the reference terminal 106, such as a ground terminal. The supply voltage may comprise any suitable voltage for the system concerned and may be selected based on a load which the LDO regulator is configured to be coupled to. In one or more examples, the input, supply, voltage may comprise a voltage greater than an operating voltage of the digital logic controller 102.

The LDO regulator 101 includes an output terminal 108 providing an output voltage VOUT which is couplable to load circuitry 109. The load circuitry may comprise a load to which the LDO regulator is configured to provide power. The load circuitry may comprise a part of the system 100. In other embodiments, the load circuitry may not form part of the system. It will be appreciated that the system may be manufactured independently from the load circuitry and may be configured to be coupled to one of a plurality of different loads.

As mentioned above, the control of the mode of the LDO regulator 101 by the digital logic controller 102 may be provided by way of any suitable control signalling. In one or more embodiments, one or more digital signals provided as the control signalling may be used to indicate the desired mode of operation to the LDO operator. In other embodiments, the control signalling may comprise encoded data signals to indicate which mode the LDO regulator should operate in. Any suitable modulation or encoding technique may be used including, but not limited to, pulse-width modulation, frequency modulation, phase-shift modulation, amplitude modulation or continuous phase modulation.

In one or more embodiments, the voltage domain of the digital logic controller 102 may be different to the voltage domain of the LDO regulator 101. Accordingly, the voltages provided by the digital logic controller to represent logic high and logic low may be different to those of the LDO circuitry. A level shifter (not shown in FIG. 1) may be provided to shift the voltage levels of the control signalling provided by the digital logic controller 102 to the LDO regulator 101.

A choice may arise in relation to how to power the digital logic controller 102. In one example, not forming part of the disclosure, the digital logic controller may receive power from an off-integrated-circuit LDO regulator or other suitable power source. In such an example the integrated circuit requires an additional input power terminal which adds to the cost and complexity of the circuit. In addition, the off-integrated-circuit LDO regulator would require an off-integrated-circuit voltage source itself. In another example, not forming part of the disclosure, the digital logic controller may receive power from an always-on LDO regulator located on the same integrated circuit as the digital logic controller. The addition of this component again adds cost and complexity to the circuit design.

In the embodiments of the present disclosure, the digital logic controller 102 is configured to receive power for the provision of the control signalling from the LDO regulator 101 to which it is configured to send control signalling for the control of the modes thereof. Accordingly, a connection 110 is provided from the output terminal 108 to the digital logic controller 102, such that the output voltage of the LDO regulator 101 provides power for the digital logic controller 102. The digital logic controller 102 may also have a connection to the reference voltage at 107. While this arrangement may simplify the provision of power to the digital logic controller 102, there are complications with such an arrangement. In order to provide reliable control signalling, the digital logic controller 102 requires a power source which provides a voltage above a minimum acceptable operating voltage. The provision of a voltage below the minimum acceptable operating voltage may result in unreliable-, suboptimal- or non-operation of the digital logic controller 102. The minimum acceptable operating voltages of electronic components may be well defined values which are known or accessible to a person skilled in the art. Such minimum acceptable operating voltages are frequently included in specification sheets for electronic components. In one or more embodiments where the digital control logic controller 102 is provided with power by the LDO regulator 101 to which it provides control signalling, at start-up the LDO regulator may not be able to provide power at a suitable voltage level to the digital logic controller. In practice, the output voltage may increase from an initial value which is below the minimum acceptable operating voltage to a final value which is above the minimum acceptable operating voltage. Start-up may be defined as the period during which the LDO regulator 104 receives power at the input terminal 104 from not receiving power at the input terminal 104 and during which the output voltage at 108 increases from a first threshold voltage to a second threshold voltage. The first threshold voltage may be zero Volts or it may be any other voltage below the minimum acceptable operating voltage of the digital logic controller 102. The second threshold voltage may be the minimum acceptable operating voltage or another voltage level which is at least higher than the minimum acceptable operating voltage. In general, start-up may comprise the period between the LDO regulator receiving power at the input terminal and normal operation of the LDO regulator in which it receives valid control signalling from the digital logic controller 102.

In one or more embodiments, the digital logic controller 102 only receives power from the LDO regulator 101.

To summarise the system 100 of FIG. 1, in one or more embodiments of the system 100 of the present disclosure, the provision of power to the digital logic controller 102 may be made by the LDO regulator 101. The LDO regulator 101 comprises LDO start-up circuitry (not shown in FIG. 1) configured to cause the LDO regulator 101, during start-up, to default to a predetermined one of a first and second mode. The LDO start-up circuitry is also configured to prevent the digital logic controller 102 from controlling the mode of the LDO regulator 101, such as for a start-up period. The reliable operation of the digital logic controller 102 cannot be guaranteed until it is supplied by sufficient power by way of the output voltage from the LDO regulator 101. However, the LDO start-up circuitry may ensure the LDO regulator 101 starts up in a mode, that is one of the first and second modes, that will provide an output voltage at 108 sufficient for the digital logic controller 102 to provide reliable control signalling.

In one or more examples, one of the first or second mode or any other operating mode may not be suitable for providing power to the digital logic controller 102 during start-up because, during start-up, those modes may not provide the minimum acceptable operating voltage to the digital logic controller 102. The LDO start-up circuitry may therefore ensure the LDO regulator 101 does not start up in such a mode.

Figure 2:
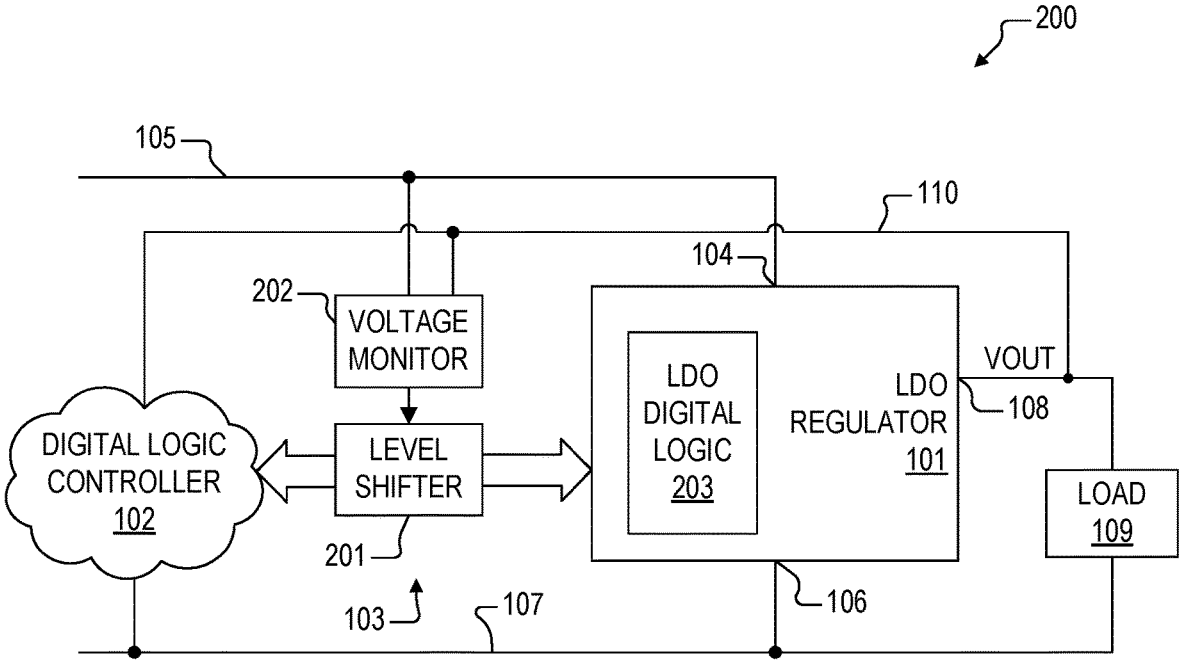
FIG. 2 shows another example embodiment of a system of the present disclosure.

FIG. 2 shows a more detailed abstraction of a system 200 of the disclosure comprising the LDO regulator 101 and the digital logic controller 102. In this example, the LDO regulator 101 includes LDO digital logic 203 to receive the control signalling from the digital logic controller 102 and place the LDO regulator in the predetermined one of the first and second modes or any mode indicated by the control signalling. In this and one or more other embodiments, the voltage domain of the digital logic controller 102 (supplied by the voltage at the output terminal of the LDO regulator at perhaps 2.5 Volts) may be different to the voltage domain of the LDO regulator 101 and any LDO digital logic 203 which may form part of the LDO regulator 101 (supplied by the voltage of rail 105 at perhaps 3 Volts) to receive the control signalling. In this embodiment the system 200 includes a level shifter 201 configured to provide for shifting of voltage levels of the control signalling output by the digital logic controller 102 prior to receipt of said control signalling by the LDO regulator 101 or, more specifically in one or more examples, LDO digital logic of the LDO regulator 101.

In the example embodiment of FIG. 2, the LDO start-up circuitry is embodied as a voltage monitor 202 which is configured to control the level shifter 201. The voltage monitor 202 may have a power supply terminal configured to couple to the voltage rail 105, which also provides the supply voltage for the LDO regulator 101. The voltage monitor 202 may also have a terminal for coupling to the reference voltage at 107 (not shown in FIG. 2). In general, the voltage monitor 202 is configured to control the output of the level shifter 201 such that the level shifter 201 provides the signalling to the LDO regulator 101, or LDO digital logic 203 thereof, to start-up in said predetermined one of the first and second modes.

Thus, the LDO start-up circuitry may comprise the voltage monitor 202, which is configured to monitor the output voltage VOUT at output terminal 108 of the LDO regulator 101. The voltage monitor 202 may be configured to prevent the digital logic controller 102 from controlling the mode of the LDO regulator 101 by sending signalling to the level shifter 201 in order to cause the level shifter 201 to operate in a first state wherein the output of the level shifter is independent of the control signalling received by the level shifter 201 from the digital logic controller 102. Instead, the signalling provided by the voltage monitor 201 may cause the level shifter 201 to provide a signal which causes the LDO regulator 101 to operate in the predetermined one of the first and second modes.

The voltage monitor 202 may also provide a second state in which the control signalling from the digital logic controller 102 is provided to the LDO digital logic 203 via the level shifter 201. The second state 201 may be provided by signalling from the voltage monitor 202 to the level shifter or the absence of signalling from the voltage monitor 202 to the level shifter 201.

The provision of the first state or the second state may be based on the voltage monitored by the voltage monitor 202. In particular, when power is provided to the LDO regulator 101 from rail 105 it may take time for the voltage provided at the output terminal 108 to reach a level at which the digital logic controller 102 may provide a reliable output (that is after the voltage reaches the minimum operating voltage of the digital logic controller 102).

Accordingly, in general, the voltage monitor 202 may be configured to provide for the first state when the voltage at the output terminal 108 is below a threshold and provide for the second state when the voltage at the output terminal 108 is above the threshold. The period the first state is in operation may be considered to be start-up and the period the second state is in operation may be considered to be normal operation.

The threshold voltage may be at least 0.5, 1, 1.5 or 2 Volts or any other voltage above the minimum acceptable operating voltage of the digital logic controller 102.

In summary, when the voltage at the output terminal 108 is below the threshold, the voltage monitor 202 causes the LDO regulator 101 to start up in the predetermined one of the first and second modes by way of providing signalling to the level shifter 201 such that the level shifter provides appropriate signalling to the LDO regulator 101, such as via the LDO digital logic 203. In this first state, any control signalling provided by the digital logic controller 102, which may be considered to be unreliable, is not passed through the level shifter 201 to the LDO regulator 101. When the voltage at the output terminal 108 is above the threshold, the voltage monitor 202 causes the control signalling from the digital logic controller 102 to be received by the LDO regulator, or LDO digital logic 203, via the level shifter 201. Thus, the voltage monitor 202 provides the second state and may no longer control the output of the level shifter 201.

The first mode of the LDO regulator may comprise a mode wherein the output voltage of the LDO regulator has, or will have after start-up, at least a voltage equal to or greater than the minimum acceptable operating voltage of the digital logic controller. In one or more embodiments the first mode may comprise a regulation mode wherein the output voltage provided at the output terminal 108 of the LDO regulator 101 is substantially constant and may be substantially independent of the (e.g. non-zero) voltage received at the input terminal 104. This mode of operation may be used when the system is supplying a load circuit 109. Accordingly, it may be preferable to start-up in this first mode. In other embodiments, the first mode may comprise a zero-current bypass mode wherein the output voltage provided at the output terminal 108 of the LDO regulator 101 is a function of the input voltage received at the input terminal 104. In one or more examples, the function provides for the output voltage at 108 to be proportional to the input voltage at 104. This mode may be used when testing the circuit, for example, after production or, in one or more examples, may be the mode used for start-up. Said testing may comprise a performance and/or functional test after manufacturing, such as a leakage test which may include a high voltage stress test. Leakage tests may include using a higher voltage to stress the load 109. Such tests may only be done after manufacture. The bypass mode itself may also be used as a normal operating mode when it is expected that during normal operation the input voltage will be low enough, so that the load is not damaged and when minimal supply current of the LDO is advantageous.

The predetermined mode may be determined during the design and manufacturing process, such as at the time of manufacture.

The second mode may comprise a mode wherein the output voltage of the LDO regulator does not have, or will not reach, a voltage equal to or greater than the minimum acceptable operating voltage of the digital logic controller. As such, the second mode may not be the predetermined one of the first and second modes that is provided at start-up. The second mode may be a zero-voltage mode wherein the LDO regulator is configured to provide a zero output voltage at 108 independent of the (e.g non-zero) supply voltage at 104.

In other embodiments, the second mode may comprise a test mode which may be unsuitable for providing the minimum acceptable operating voltage to the digital logic controller. In one or more examples, the test mode may comprise a test mode used to test a PMOS transistor (302 in FIG. 3) of the LDO regulator. The PMOS transistor may be configured to control the power between input 104 and output 108. It may comprise the component that isolates the load 109 from the input voltage at 104.

In one or more examples, the LDO regulator 101 may include one or more "test" terminals (301 in FIG. 3) for the placing of the LDO regulator 101 in the test mode on receipt of signalling at the test terminal. The test mode for testing the PMOS transistor mentioned above may comprise testing of parts of a PMOS transistor individually. In another example test mode, there may be provided a constant current test mode. In this test mode, the LDO regulator 101 may be configured such that the output voltage of the LDO is loaded with an internal test current, such that performance can be judged by a suitable measurement. This may be done during production test, and/or in between normal operation modes usage. Receipt of the test signal at the test terminal 301 may cause the LDO digital logic to override the control signalling provided by the digital logic controller. In one or more other embodiments, the test signal may act on the digital logic controller 102 to control the control signalling output by the digital logic controller. In one or more examples, the test signal may be considered to be the control signalling to the LDO digital logic. The LDO regulator 101 may override the control signalling by causing the level shifter to prevent control signalling from the digital logic controller 102 from being provided to the LDO regulator for the duration of the test. In other examples, receipt of a test signal at the LDO regulator may cause the LDO regulator to ignore control signalling received from the digital logic controller 102, such as by replacing it, or may control the control signalling output by the digital logic controller 102. The receipt of a test signal at the test terminal, in other examples, may not result in a test mode being entered until the output voltage of the system has increased beyond the threshold. Testing of the system may, for example, be performed shortly after manufacture of the system in order to ensure proper operation. In some examples, providing a test terminal for receiving a test signal may provide a particularly convenient way of initiating testing immediately after start-up has completed, thereby reducing wait times for testing the system post-manufacturing.

FIG. 3 shows the example embodiment of FIG. 2 in more detail. The level shifter 201, voltage monitor 202 and LDO digital logic 203 are shown as part of a general "control logic" box. The LDO regulator 101 is shown to include said PMOS 302.

The digital logic controller 102 may include power-on-reset (POR) circuitry 303 configured to cause the digital logic controller 102 to start up in a predetermined state and thereby provide predetermined control signalling. The predetermined control signalling may provide for selection of the predetermined one of the first and second mode. Accordingly, the LDO start-up circuitry 202 may be provided in addition to any power-on-reset circuitry of the digital logic controller 102.

FIG. 4 shows an example embodiment of the startup operation of the system 100, 200. The flowchart starts with the output voltage from the LDO regulator 101 at 0 V. Power is provided at the rail 105, which is received by both the voltage monitor 202 (or another embodiment of the LDO start-up circuitry) and the LDO regulator 101. Accordingly, step 401 shows the LDO regulator 101 beginning the start up in the predetermined one of the first and second modes due to the voltage monitor's control of the level shifter 201. Step 402 shows the output voltage VOUT that is output from the LDO regulator at 108 having reached approximately 0.5 V (other levels are possible). Step 403 shows the power-on reset circuitry of the digital logic controller 102 become active to initialise the digital logic controller 102 to provide the control signalling. Step 404 shows the output voltage VOUT that is output from the LDO regulator at 108 having reached approximately 1 V (other levels are possible). At this voltage, the LDO regulator 101 may be receiving sufficient power to adopt the predetermined one of the first and second modes. At step 407, the output voltage VOUT that is output from the LDO regulator at 108 has reached approximately 2 V (other levels are possible). At 2 Volts the digital logic controller 102 at next step 408 may be considered active and the voltage monitor 202 may provide the second state in which the digital logic controller takes over control of the mode of the LDO regulator. This is now "normal" operation.

Step 405 shows a decision point which may be activated by the receipt of a signal at the above-mentioned test terminal. If such a signal is received the method may proceed to step 409 in which the LDO regulator 101 is placed in the test mode. If such a signal is not received, the method may proceed to step 406 to begin normal operation. After either step 408 or 409, startup operation is completed and operation continues in either normal mode or test mode, respectively.

The instructions and/or flowchart steps in the above figures can be executed in any order, unless a specific order is explicitly stated. Also, those skilled in the art will recognize that while one example set of instructions/method has been discussed, the material in this specification can be combined in a variety of ways to yield other examples as well, and are to be understood within a context provided by this detailed description.

In some example embodiments the set of instructions/method steps described above are implemented as functional and software instructions embodied as a set of executable instructions which are effected on a computer or machine which is programmed with and controlled by said executable instructions. Such instructions are loaded for execution on a processor (such as one or more CPUs). The term processor includes microprocessors, microcontrollers, processor modules or subsystems (including one or more microprocessors or microcontrollers), or other control or computing devices. A processor can refer to a single component or to plural components.

In other examples, the set of instructions/methods illustrated herein and data and instructions associated therewith are stored in respective storage devices, which are implemented as one or more non-transient machine or computer-readable or computer-usable storage media or mediums.

Such computer-readable or computer usable storage medium or media is (are) considered to be part of an article (or article of manufacture). An article or article of manufacture can refer to any manufactured single component or multiple components. The non-transient machine or computer usable media or mediums as defined herein excludes signals, but such media or mediums may be capable of receiving and processing information from signals and/or other transient mediums.

Example embodiments of the material discussed in this specification can be implemented in whole or in part through network, computer, or data based devices and/or services. These may include cloud, internet, intranet, mobile, desktop, processor, look-up table, microcontroller, consumer equipment, infrastructure, or other enabling devices and services. As may be used herein and in the claims, the following non-exclusive definitions are provided.

In one example, one or more instructions or steps discussed herein are automated. The terms automated or automatically (and like variations thereof) mean controlled operation of an apparatus, system, and/or process using computers and/or mechanical/electrical devices without the necessity of human intervention, observation, effort and/or decision.

It will be appreciated that any components said to be coupled may be coupled or connected either directly or indirectly. In the case of indirect coupling, additional components may be located between the two components that are said to be coupled.

In this specification, example embodiments have been presented in terms of a selected set of details. However, a person of ordinary skill in the art would understand that many other example embodiments may be practiced which include a different selected set of these details. It is intended that the following claims cover all possible example embodiments.

The invention claimed is:

1. A system comprising: a low drop-out, LDO, regulator configured to receive a supply voltage at an input terminal and provide an output voltage at an output terminal based on a function of the supply voltage, the LDO regulator configured to be switchable between at least a first mode and a second mode, wherein the first and second modes each define the output voltage provided to the output terminal based on different functions of the supply voltage; a digital logic controller configured to select the mode of the LDO regulator by providing control signalling to the LDO regulator, the digital logic controller configured to receive power for the provision of the control signalling from the output voltage provided by the LDO regulator; and a level shifter configured to receive said control signalling from the digital logic controller and to provide for shifting of voltage levels of said control signalling output by the digital logic controller prior to receipt of said control signalling by a LDO digital logic; wherein the LDO regulator comprises LDO start-up circuitry configured to control the level shifter and to cause the LDO regulator, during start-up, to default to a predetermined one of the first and second mode and the LDO start-up circuitry further configured to prevent the digital logic controller from controlling the mode of the LDO regulator.

2. The system of claim 1, wherein the LDO start-up circuitry is configured to monitor the output voltage at the output terminal of the LDO regulator and, based on the monitored voltage being below a threshold, cause the LDO regulator to default to the predetermined one of the first and second mode and prevent the digital logic controller from controlling the mode of the LDO regulator.

3. The system of claim 1 wherein the LDO regulator is provided on an integrated circuit and the digital logic controller is provided on the same integrated circuit.

4. The system of claim 1, wherein the LDO regulator includes the LDO digital logic to receive the control signalling from the digital logic controller and place the LDO regulator in one of the first and second mode; and wherein the LDO start-up circuitry is configured to control the output of the level shifter such that the LDO start-up circuitry and the level shifter provide: a first state wherein the control signalling is prevented from being provided to the LDO digital logic and, instead, predetermined signalling is provided to the LDO digital logic to cause the LDO regulator to operate in the predetermined mode; and a second state wherein the control signalling from the digital logic controller is provided to the LDO digital log.

5. The system of claim 4 wherein the LDO start-up circuitry is configured to monitor the output voltage provided to the digital logic controller by the LDO regulator wherein the LDO start-up circuitry is further configured to provide signalling to the level shifter to provide the first state and the second state based on the output voltage.

6. The system of claim 5 wherein the LDO start-up circuitry is configured to provide signalling to the level shifter to provide:

the first state when the output voltage is above a first threshold voltage and below a second threshold voltage, the second threshold voltage greater than the first threshold voltage; and the second state when the output voltage is above the second threshold.

7. The system of claim 1 wherein the first mode is configured to provide an output voltage that is greater than or equal to a minimum acceptable operating voltage of the digital logic controller to the digital logic controller and the second mode is configured to provide an output voltage which is below the minimum acceptable operating voltage of the digital logic controller to the digital logic controller, wherein the predetermined one of the first and second mode is the first mode.

8. The system of claim 1 wherein the first mode comprises one of:

a regulating mode wherein the output voltage provided at the output terminal is a substantially constant, non-zero output voltage; and a zero-current bypass mode wherein the output voltage provided at the output terminal is dependent on the supply voltage received at the input terminal; and the second mode comprises one of:

a zero-voltage mode wherein the output voltage is equal to, or substantially equal to zero relative to a reference voltage; and a test mode.

9. The system of claim 1 wherein the LDO regulator comprises a test terminal for receiving a test signal indicative that the system is to be tested, wherein the LDO regulator is configured to, based on receipt of the test signal, override the control signalling from the digital logic controller and enter a test mode.

10. The system of claim 1 wherein the output voltage is configured to be provided to load circuitry in addition to the digital logic controller for the provision of power to the load circuitry.

11. A telecommunications system comprising the system of claim 1.

12. A method of operating a system, the system comprising a low drop-out LDO, regulator configured to receive a supply voltage at an input terminal and provide an output voltage at an output terminal based on a function of the supply voltage, the LDO regulator configured to be switchable between at least a first mode and a second mode, wherein the first and second modes each define the output voltage provided to the output terminal based on different functions of the supply voltage; a digital logic controller configured to select the mode of the LDO regulator by providing control signalling to the LDO regulator, the digital logic controller configured to receive power for the provision of the control signalling from the output voltage provided by the LDO regulator; and a level shifter configured to receive said control signalling from the digital logic controller and to provide for shifting of voltage levels of said control signalling output by the digital logic controller prior to receipt of said control signalling by a LDO digital logic; the method comprising: during start-up, controlling the level shifter by LDO start-up circuitry, causing the LDO regulator to default to a predetermined one of the first and second mode; and during start-up, controlling the level shifter by LDO start-up circuitry, preventing the digital logic controller from controlling the mode of the LDO regulator.

13. The method of claim 12 comprising switching, LDO start-up circuitry, from a first state to a second state;

the first state comprising preventing the digital logic controller from providing the control signalling to the LDO regulator and, instead, providing predetermined signalling to the LDO regulator to cause the LDO regulator to operate in the predetermined mode; and the second state comprising allowing the digital logic controller to provide the control signalling to the LDO regulator;

wherein the method further comprises monitoring the output voltage provided to the digital logic controller by the LDO regulator and controlling said switching based on the output voltage.

14. The method of claim 13 comprising causing the system to operate in:

the first state when the output voltage is above a first threshold voltage; and the second state when the output voltage is above a second threshold.

15. The method of claim 13 wherein the level shifter is configured to provide for shifting of voltage levels of the control signalling output by the digital logic controller prior to receipt of said control signalling by the LDO digital logic provided within the LDO regulator, and wherein said first state and said second state are provided by the LDO start-up circuitry controlling the output of the level shifter.

16. The method of claim 15 wherein the method comprises;

based on receipt of a test signal at the LDO regulator, preventing the digital logic controller from controlling the mode of the LDO regulator; and causing the LDO regulator to operate in a test mode.

17. The method of claim 16, wherein the system is configured so that receipt of the test signal replaces the control signalling.

18. The method of claim 12 comprising causing the system to operate in:

a first state when the output voltage is above a first threshold voltage; and a second state when the output voltage is above a second threshold.

19. The method of claim 18 wherein the level shifter configured to provide for shifting of voltage levels of the control signalling output by the digital logic controller prior to receipt of said control signalling by the LDO digital logic provided within the LDO regulator, and wherein said first state and said second state are provided by the LDO start-up circuitry controlling the output of the level shifter.

20. A telecommunications system comprising the system of claim 12.

* * * * *